US006635095B2

(12) United States Patent
Tanaka

(10) Patent No.: US 6,635,095 B2
(45) Date of Patent: Oct. 21, 2003

(54) OIL SEPARATOR

(75) Inventor: Jiro Tanaka, Nishi-kasugai-gun (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 10/054,974

(22) Filed: Jan. 25, 2002

(65) Prior Publication Data

US 2002/0129586 A1 Sep. 19, 2002

(30) Foreign Application Priority Data

Mar. 13, 2001 (JP) ..... 2001-070076
Mar. 13, 2001 (JP) ..... 2001-070088

(51) Int. Cl.[7] ..... B01D 50/00; B01D 35/30

(52) U.S. Cl. ..... 55/337; 55/385.3; 55/447; 55/DIG. 19; 96/189

(58) Field of Search ..... 55/320, 337, 385.3, 55/DIG. 19, 447, 503; 96/188, 189

(56) References Cited

U.S. PATENT DOCUMENTS 3,483,677 A * 12/1969 Pinto ..... 96/137
4,269,607 A 5/1981 Walker
4,272,371 A 6/1981 Moses et al.
4,920,930 A 5/1990 Sakano et al.
5,335,512 A 8/1994 Hancock et al.
5,586,996 A * 12/1996 Manookian, Jr. ..... 55/321
6,048,376 A 4/2000 Miller
6,171,355 B1 1/2001 Gieseke et al.
6,500,243 B2 * 12/2002 Cook et al. ..... 96/189

FOREIGN PATENT DOCUMENTS

| | | |
|---|---|---|
| DE | 19 00 827 | 12/1969 |
| EP | 0 353 903 | 2/1990 |
| JP | 54-180850 | 6/1953 |
| JP | 3-32113 | 3/1991 |

* cited by examiner

*Primary Examiner*—Robert A. Hopkins
(74) *Attorney, Agent, or Firm*—Oblon, Spivak, McClelland, Maier & Neustadt, P.C.

(57) ABSTRACT

An object of the present invention is to provide an oil separator which can be manufactured at a low cost and can prevent the leakage of removed oil, and an oil separator which has improved separation efficiency of the oil mist without increasing the pressure loss; in order to achieve the object, the present invention provide an oil separator for separating oil from a gaseous fluid containing oil in the state of a mist comprising: a hollow case body comprising an opening at the top thereof; a lid for covering the opening formed at the case body; and a filter in the case body, wherein an entrance for inward flow of the gaseous fluid into the case body is formed at the lower side of the case body, an exit for outward flow of the gaseous fluid is formed at the lid, and an outflow exit for outward flow of oil which has been separated is formed at the bottom of the case body.

2 Claims, 10 Drawing Sheets

OIL SEPARATOR

BACKGROUND OF THE INVENTION

1. Field of the Invention

The present invention relates to an oil separator for separating the oil mist from gaseous fluids, such as a blowby gas, and in particular, to an oil separator which is suitably used in a gas engine for a gas heat pump type air conditioner.

2. Description of the Related Art

An air conditioner, in which a heat pump is used for cooling and heating operations, is provided with a refrigerant circuit comprising an indoor heat exchange apparatus, a compressor, an outdoor heat exchange apparatus, an expansion valve, etc. When the refrigerant circulates in the refrigerant circuit and exchanges heat with air in the indoor heat exchange apparatus and the outdoor heat exchange apparatus, the air conditioned chamber is heated or cooled. In addition, in order to heat the chamber, not only the outdoor heat exchange apparatus but also a refrigerant heating apparatus for heating the refrigerant directly is sometimes provided in the refrigerant circuit.

In recent years, an air conditioner has been suggested, which comprises a gas engine, instead of an ordinary motor, as a driving source for the compressor provided in the refrigerant circuit. An air conditioner utilizing a gas engine is called a gas heat pump type air conditioner (abbreviated as "GHP" below). The GHP can use gas, which is relatively cheap, as fuel; therefore, the running cost thereof can be reduced, compared with an air conditioner comprising a compressor driven by the ordinary motor (abbreviated as "EHP" below).

Moreover, in the GHP, when waste heat of gas at a high temperature discharged from the gas engine during the heating operation is used as the heat source for the refrigerant, the heating ability can be improved, and the use efficiency of energy can also be improved. In addition, when the waste heat of the gas discharged from the gas engine is used in the GHP, the GHP does not require a special device, such as the refrigerant heating device explained above.

Furthermore, the GHP can utilize the engine waste heat to defrost the outdoor heat exchange apparatus during the heating operation. In general, the EHP defrosts the outdoor heat exchange apparatus by stopping the heating operation and temporarily performing the cooling operation. That is, when the EHP defrosts, cooled air is introduced into the chamber. Therefore, a person in the chamber feels unpleasant. In contrast, the GHP can utilize the waste heat, and it can continuously perform the heating operation without such the problem which is caused by the EHP.

The GHP has many advantages as explained above; however, it also has the following problems.

As explained above, the GHP uses the gas engine as a driving source for the compressor. In the gas engine, oil contained in the blowby gas may rise to problems. The blowby gas is gas which leaks from the combustion chamber into a crank case through a gap between the piston ring and the cylinder. In general, the blowby gas is returned from the crank case into an engine intake system and is then sent to the combustion chamber again.

Since the blowby gas contains a lubricating oil in a the state of a mist (abbreviated as "oil mist" below), at a suitable positions on a line for the flow of the blowby gas (abbreviated as "blowby gas line" below), oil separators for accumulating and removing the oil mist, such as a blowby gas filter, are provided.

FIGS. 11, 12A, and 12B show a conventional oil separator which is used as a blowby gas filter. In the figures, reference number 140 denotes an oil separator, 141 denotes a case body, 142 denotes a lid, 143 denotes a filter, 144 denotes gaseous fluid entrance, 145 denotes a gaseous fluid exit, and 146 denotes an outflow exit for the oil mist accumulated by the filter 143. Moreover, the case body 141 and the lid 142 comprise the casing of the oil separator 140.

In the oil separator 140, the blowby gas, which flows in through the entrance 144 connected to the crank case of the gas engine, passes through the filter 143 and is sucked through the exit 145 by the intake system of the gas engine. The oil mist contained in the blowby gas is separated and removed as it passes through the filter 143, falls to the bottom of the case body 141, and is then returned to the oil pan of the gas engine through the outflow exit 146. In the oil separator 140, in order to improve the separation efficiency of the oil mist, the height of the filter 143, through which the blowby gas passes, is increased as much as possible. It is necessary to replace the filter 143 after a given operation time of the oil separator 140. Therefore, in order to change the filter 143, the lid 142 can detach from the case body 141. In addition, in order to easily change the filter 143, the lid 142 is attached at the side of the case body 141, where an opening having the largest area can be formed.

However, if the lid 142 is formed at the side of the case body 141, there is the possibility that the oil falling to the bottom of the case body 141 will leak from a gap between the case body 141 and the lid 142. In particular, when the oil mist contained in the blowby gas is separated and removed in the oil separator 140, the pressure at the bottom of the case body 141 where the outflow exit 146 is provided is greater than the atmospheric pressure at the outside of the case body 141. That is, the pressure at the bottom of the case body 141 where the outflow exit 146 is provided in a positive pressure region. Therefore, there may be oil leak due to the pressure difference, at any gap occurring at the contact portion.

An oil leakage can be solved by improving the seal between the case body 141 and the lid 142. However, in order to obtain a good seal, the structure of the contact portion must be complicated; therefore, a cost for manufacturing the oil separator will increase. In addition, since the case body 141 and the lid 142 are made of synthetic resins, if the structure thereof is complicated, their formability may be decreased.

In addition, in the conventional oil separator 140, since the filter 143 is made of nonwoven fabrics, which have inferior shape maintaining properties, there is the problem that a gap S can easily occur between the filter 143 and the inside wall of the case body 141, as shown in FIG. 12A. If the gap S is generated, the blowby gas containing the oil mist passes through the gap S and flows out through the exit 145, without passing through the filter 143. The gap S decreases the separation efficiency of the oil mist in the oil separator 140. Therefore, it is desired for the blowby gas to pass with certainty through the filter 143. In addition, in the conventional oil separator 140, since the separation of the oil mist is carried out by only the filter 143, there is the problem that it is difficult to obtain a sufficient separation efficiency. In this case, the separation efficiency can be improved by increasing the thickness of the filter 143. However, an increase in the thickness of the filter 143 causes a significant pressure loss. Therefore, the separation efficiency cannot be sufficiently improved only by increasing the thickness of the filter 143. In the light of the above, it is desired to provide oil separator in which the oil mist contained in the blowby gas can be efficiently separated without increasing the pressure loss.

Therefore, one of objects of the present invention is to improve the performances of the oil separator for removing the oil mist from the gaseous fluids, such as the blowby gas. In particular, an object of the present invention is to provide an oil separator which can be manufactured at a low cost and can prevent the leakage of removed oil, and an oil separator which has improved separation efficiency of the oil mist contained in the gaseous fluids without increasing the pressure loss.

SUMMARY OF THE INVENTION

In order to achieve the object, the present invention provides an oil separator for separating oil from a gaseous fluid containing oil in the state of a mist comprising: a hollow case body comprising an opening at the top thereof; a lid for covering the opening formed at the case body; and a filter in the case body; wherein an entrance for flowing of the gaseous fluid into the case body is formed at the lower side of the case body, an exit for outward flow of the gaseous fluid is formed at the lid, and an outflow exit for outward flow of oil which has been separated is formed at the bottom of the case body.

In the oil separator, since the opening, which is formed at the top of the case body, is covered with the lid, the case body and the lid do not come into contact with each other at the bottom of the case body, i.e., at the portion to which the separated oil descends. Therefore, it is possible to flow out with certainty the separated and removed oil from the oil separator without oil leaks at the contact portion between the case body and the lid. In addition, the separator has a simple structure and it can be manufactured at a low cost.

In the oil separator, it is preferable to provide a guide for introducing the gaseous fluid flowing from the entrance to the exit into the center of the filter.

In the oil separator, since the gaseous fluid is introduced into the center of the filter by the guide, the amount of the gaseous fluid which does not pass through the filter can be significantly decreased. If there is a gap between the filter and the inside wall of the case body, it is possible to improve the separation efficiency of the oil mist.

In the oil separator, it is preferable for the guide to be a cylindrical member provided at the bottom surface of the lid so as to protrude toward the inside of the case body, or to be a plate ring member provided at the inside wall of the case body above the entrance so as to protrude toward the inside of the case body.

In addition, in the oil separator, it is preferable for the case body to comprise a large upper portion in which the filter is placed and a small lower portion in which the entrance and the outflow exit are provided, and for the gaseous fluid flowing from the entrance to the exit to be introduced into the center of the filter at a connection portion between the large upper portion and the small lower portion.

In the oil separator, since the connection portion between the large upper portion and the small lower portion acts as a guide for introducing the gaseous fluid into the center of the filter, if there is the gap between the filter and the case body and the lid, it is possible to improve the separation efficiency of the oil mist.

In the oil separator, it is preferable for the gaseous fluid entrance and the outflow exit for the separated oil to be formed in a positive pressure region, and for the gaseous fluid exit to be formed in a negative pressure region.

If the gaseous fluid is a blowby gas for an internal combustion engine, the positive pressure region is connected to the crank case of the internal combustion engine, and the negative pressure region is connected to the intake system of the internal combustion engine. Therefore, in the oil separator, since the contact portion between the case body and the lid is formed in a negative pressure region, that is, the pressure at the connection portion is lower than the pressure outside of the case body, i.e., lower than the atmospheric pressure, the oil is less likely to leak from the oil separator.

In addition, if the oil separator is used to remove the oil mist from the blowby gas of the internal combustion engine, since the gaseous fluid exit is connected to the intake system, it is possible to easily form a negative pressure region.

In order to achieve the object, the present invention provides another oil separator for separating oil from a gaseous fluid containing oil in the state of a mist comprising: a circular flow formation portion for generating a circular flow of the gaseous fluid introduced in the casing and a filter portion in which the circular flow of the gaseous fluid passes.

In the oil separator, the oil mist is separated by the centrifugal force occurring due to the circular flow formation portion and by passing through the filter. In other words, the oil mist is separated from the gaseous fluid due to the effects provided by the circular flow formation portion and the filter. Therefore, it is possible to improve the separation efficiency without increasing the pressure loss.

In the oil separator, it is preferable to provide an entrance for inward flow of the gaseous fluid at the lower side of a casing, an exit for outward flow of the gaseous fluid at the top surface of the casing, an outflow exit for outward flow of the oil which has been separated is formed at the bottom of the casing, and the circular flow formation portion is provided at the lower portion of the casing.

In the oil separator, since the gaseous fluid passes through the circular flow formation portion and thereby the amount of the oil mist contained in the gaseous fluid decreases due to the centrifugal force, a gaseous fluid containing only a small amount of oil mist passes through the filter. In addition, the oil removed by the centrifugal force flows out the casing through the outflow exit without passing through the filter place portion. Therefore, it is possible to increase the operation life of the filter. In addition, oil separated and removed by the filter descends due to its own weight and flows out the casing through the outflow exit.

In addition, it is preferable for the position and the direction of the opening of the gaseous fluid entrance to be adjusted such that the gaseous fluid is introduced into the casing along the inside wall of the casing. As a result, it is easy for the gaseous fluid to form a circular flow.

In addition, it is also preferable to provide a circular flow formation guide for the gaseous fluid in the circular flow formation portion. This makes it easy to form a circular flow. Furthermore, it is also preferable for the gaseous fluid exit to be provided at the center of the top surface of the casing. This makes it possible to generate the circular flow of the gaseous fluid.

It is preferable for the gaseous fluid to be the blowby gas of the internal combustion engine, for the gaseous fluid entrance to be connected to the crank case of the internal combustion engine, and for the gaseous fluid exit to be connected to the intake system of the internal combustion engine. Due to this, since the gaseous fluid pushed out by the crank case at a positive pressure is taken into the intake system at a negative pressure through the oil separator, it is possible to generate a smooth flow of the gaseous fluid in the oil separator.

DETAILED DESCRIPTION OF THE PREFERRED EMBODIMENTS

Referring the figures, preferred embodiments of the oil separator according to the present invention will be explained below.

First, as the device which comprises the oil separator of the present invention, the GHP will be explained.

Figure 9:
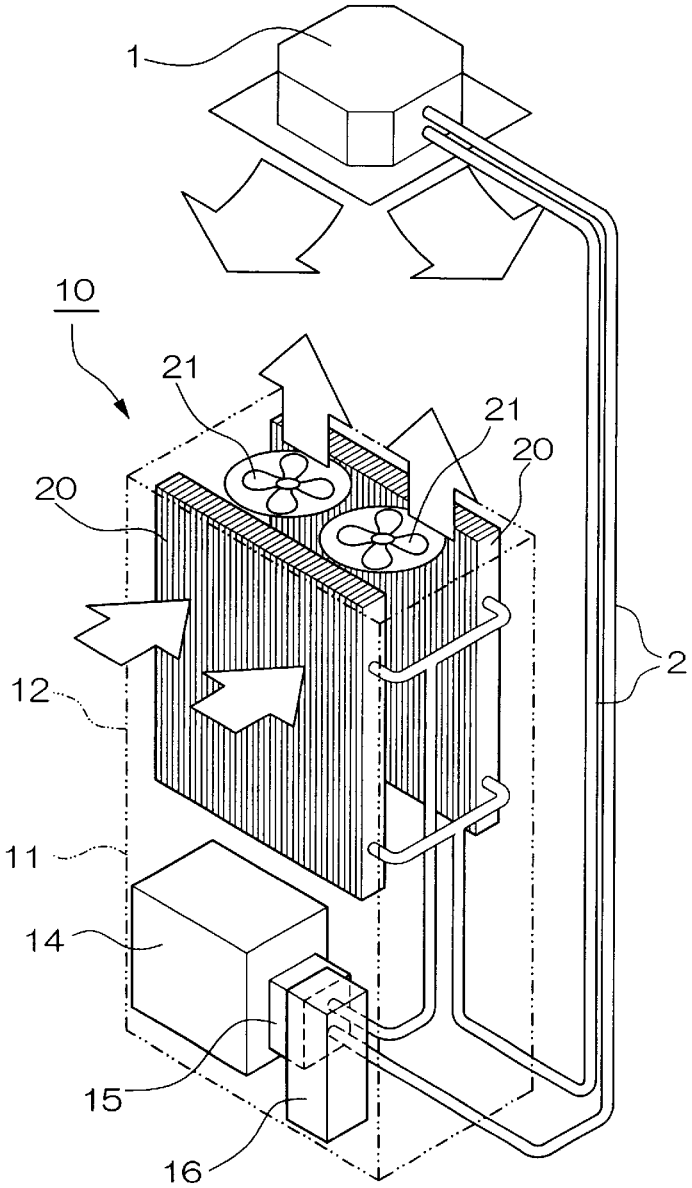
FIG. 9 shows a GHP which comprises the oil separator according to the present invention.

As shown in FIG. 9, the GHP comprises mainly the indoor unit 1 and the outdoor unit 10.

The indoor unit 1 comprises the indoor heat exchange apparatus. During the cooling operation, the indoor heat exchange apparatus evaporates a liquid refrigerant of low temperature and low pressure, and thereby absorbs heat from the indoor air, that is, it cools the indoor air. The liquid refrigerant of low temperature and low pressure is supplied to the indoor heat exchange apparatus through the refrigerant pipe 2 from the outdoor unit 10 explained below.

During the heating operation, the indoor heat exchange apparatus condenses and liquefies a gaseous refrigerant of high temperature and high pressure, and thereby discharges heat to the indoor air, that is, it warms the indoor air. The gaseous refrigerant of high temperature and high pressure is supplied to the indoor heat exchange apparatus through the refrigerant pipe 2 from the outdoor unit 10 explained below.

Moreover, the indoor air is sucked by the indoor fan which is not shown in the figures, passes through the indoor heat exchange apparatus and thereby exchanges heat with the refrigerant. After that, the indoor air is blown out in the air-conditioned chamber.

The outdoor unit 10 comprises a refrigerant circuit which comprises a compressor, an outdoor heat exchange apparatus, an expansion valve, and a four-way valve and a gas engine portion which comprises a gas engine for driving the compressor, an electric motor, and auxiliary equipment.

The inside of the outdoor unit 10 is divided into top and bottom parts by a partition which is not shown in FIG. 9. The bottom part of the outdoor unit 10 is the machine chamber 11 which comprises mainly the gas engine 14, the compressor 15, and the controller 16. The top part of the outdoor unit 10 is a heat exchange chamber 12 which comprises mainly the outdoor heat exchange apparatus 30, and the outdoor fan 31. In addition, a ventilation opening is formed at the partition, and thereby the machine chamber 11 is connected to the heat exchange chamber 12.

Figure 10:
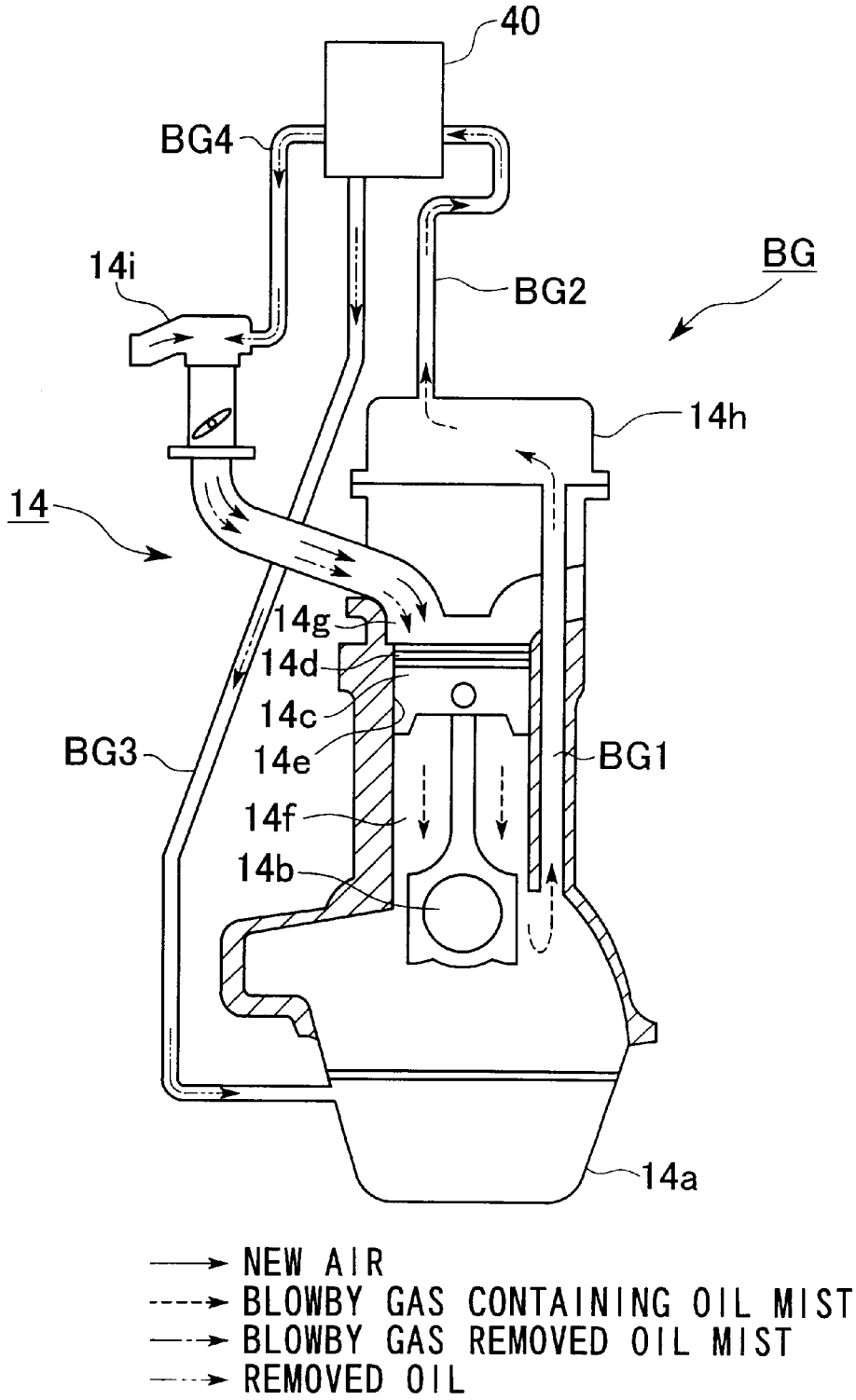
FIG. 10 shows the flows of the blowby gas in the GHP shown in FIG. 9.

FIG. 10 shows the flow of the blowby gas in the gas engine 14. The gas engine 14 comprises the oil pan 14*a*, the crank shaft 14*b*, the piston 14*c*, the piston ring 14*d*, the cylinder 14*e*, the crank case 14*f*, the combustion chamber 14*g*, the cylinder head cover 14*h*, and the intake manifold 14*i*. The blowby gas is gas which leaks from the combustion chamber 14*g* into the crank case 14*f* by passing through the gap between the piston ring 14*d* and the cylinder 14*e*, and it contains the combustible fuel, the lubricating oil in the state of a mist, the discharge gas, and the like.

As shown by an arrow with broken lines in FIG. 10, the blowby gas containing the oil mist which descends into the crank case 14*f* passes through the passage BG1 and is introduced into the cylinder head cover 14*h*. The cylinder head cover 14*h* is connected to the blowby gas filter 40 via the outflow passage BG2. Due to this structure, the blowby gas is introduced into the blowby gas filter 40 from the cylinder head cover 14*h*. In addition, as shown by an arrow with two-dot chain lines, the oil which is separated from the blowby gas by the blowby gas filter 40 passes through the oil return hose BG3 due to its own weight and is returned into the oil pan 14*a*. Then the oil is mixed with the lubricating oil in the oil pan 14*a*, and used again. As shown by an arrow with dashed lines, the blowby gas from which the oil mist has been separated by the blowby gas filter 40 passes through the blowby gas return passage BG4 and is then taken into a portion of the engine intake system, such as the intake manifold 14*i*. The blowby gas which has been taken into the intake manifold 14*i* is mixed with new air which is shown by an arrow with a line, returns into the combustion chamber 14*g*, and it is burned with the fuel gas.

The blowby gas filter 40 which is used as an oil separator can have the following structure.

(First Embodiment)

Figure 1:
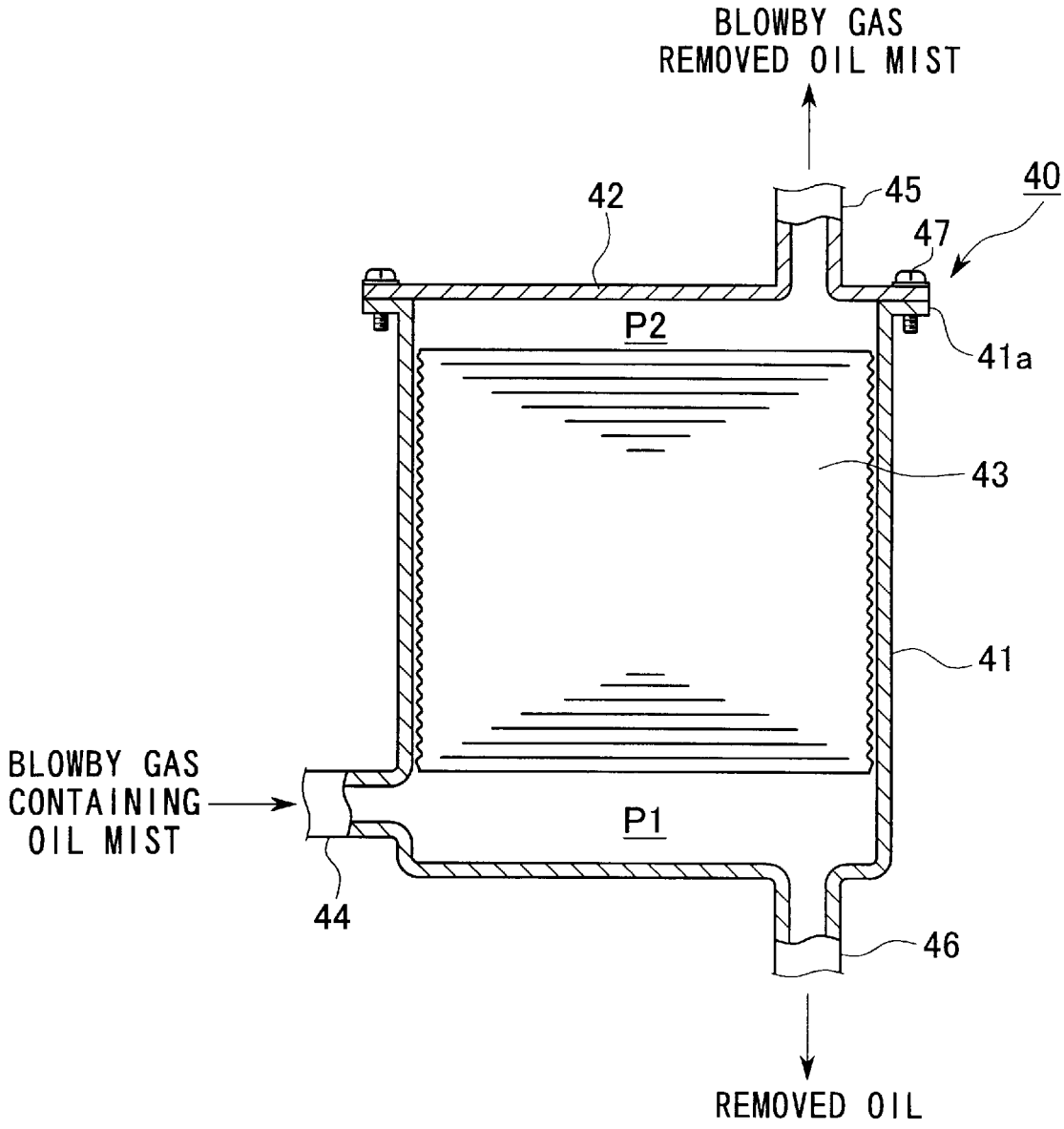
FIG. 1 is a cross-sectional view showing the first embodiment of the oil separator according to the present invention.
Figure 4:
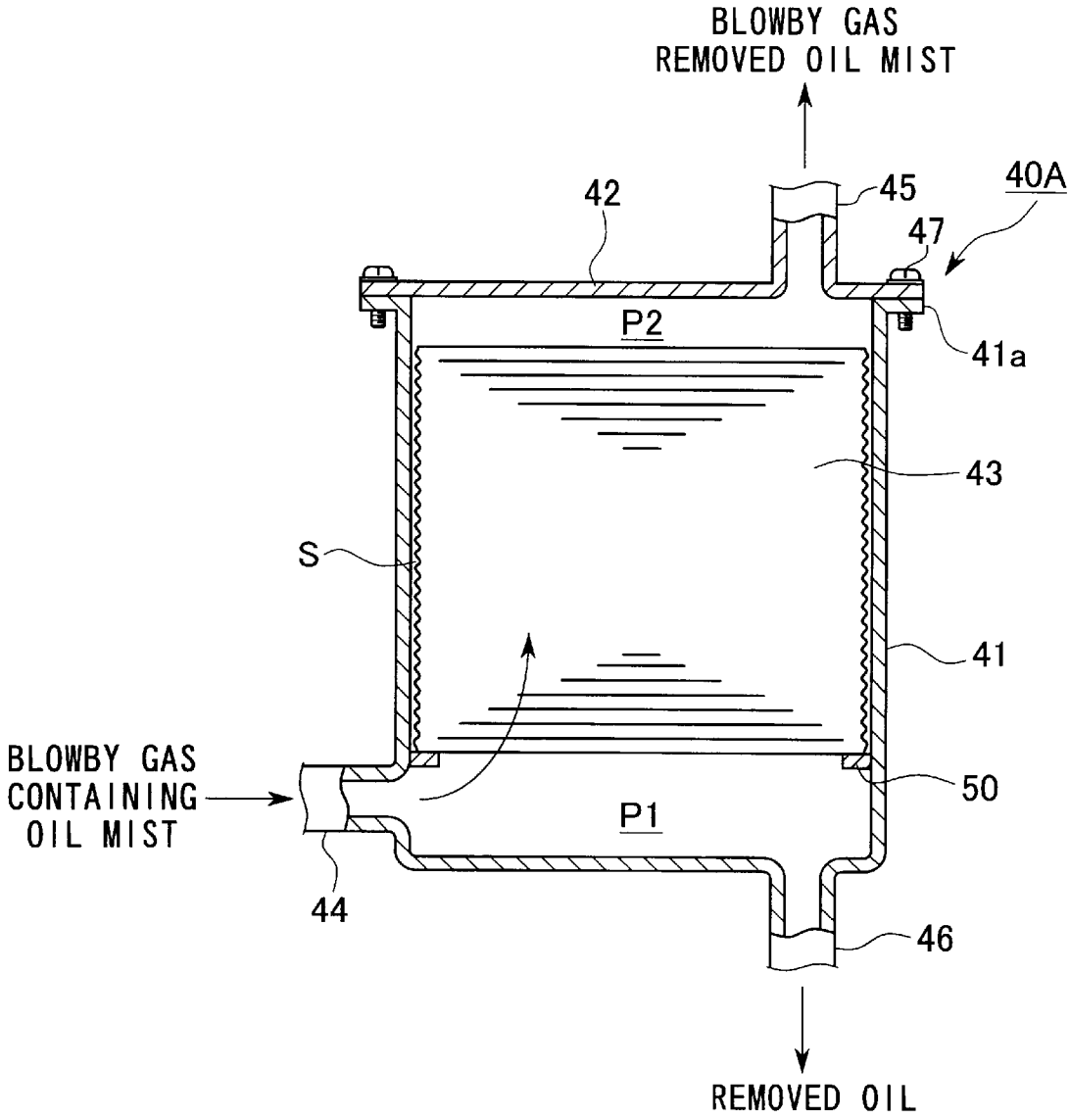
FIG. 4 is a cross-sectional view showing the second embodiment of the oil separator according to the present invention.

As shown in FIG. 1, the blowby gas filter 40 of this embodiment comprises the hollow case body 41 comprising the opening at the top thereof, the lid 42 for covering the opening formed in the case body 41, and the filter 43 which is made of nonwoven fabrics and is put into the case body 41. In FIG. 4, reference numeral 44 denotes the entrance for inward flow of the blowby gas containing the oil mist, 45 denotes the exit for outward flow of the blowby gas in which the oil mist has been separated, and 46 denotes the outflow exit for outward flow of the separated oil.

Figure 2:
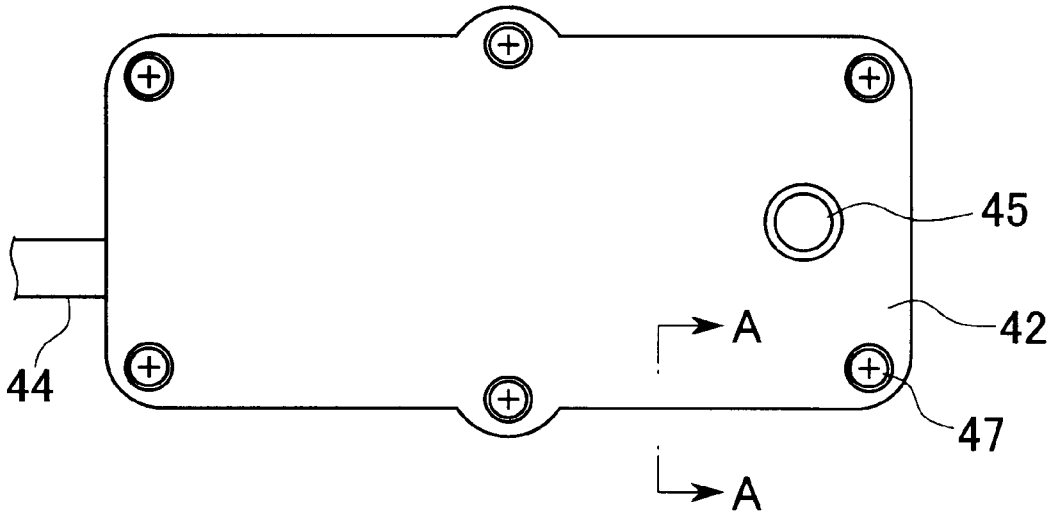
FIG. 2 is a planar view showing the oil separator shown in FIG. 1 viewed from the top side.
Figure 3:
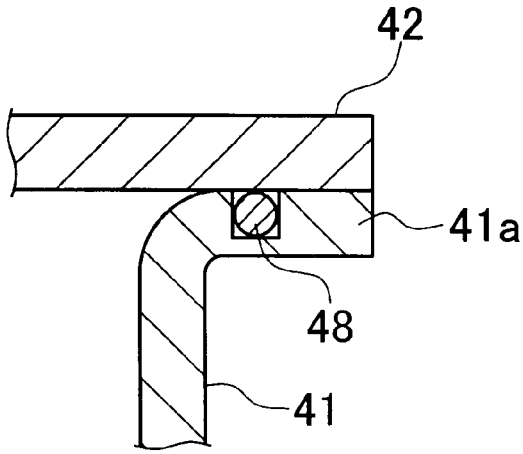
FIG. 3 is a cross-sectional view along line A—A of FIG. 2.

The case body 41 has a hollow rectangular shape, and is made of synthetic resins. At the top of the case body 41, an opening is provided. Around the opening, the flange 41*a* is provided. In addition, as shown in FIG. 2, the lid 42 is a plate member made of synthetic resins having a size approximately equal to the flange 41*a*. The case body 41 and the lid 42 are fixed by covering the opening with the lid 42 and bolting them together using the fixing members 47. As the fixing member 47, members, which can removably attach the lid 42, such as a bolt and a nut, can be used. In addition, as shown in FIG. 3, the O-ring 48 which is a seal member is provided in the flange 41*a*.

The case body 41 comprises the entrance 44 for inward flow of the blowby gas containing the oil mist, and the outflow exit 46 for outward flow of the oil which has been separated and removed from the blowby gas. The blowby gas entrance 44 is provided at the lower side of the case body 41, and connected to the crank case 14*f* of the gas engine 14 via a pipe. The outflow exit 46 is provided at the bottom of the case body 41 so as to accumulate the oil which descends due to its own weight, and connected to the oil pan 14*a* via a pipe. The blowby gas entrance 44 and the outflow exit 46 are provided in a positive pressure region P1 which is formed below the filter 43. Since the positive pressure region P1 is connected to the crank case 14*f*, the pressure in the positive pressure region P1 is greater than the pressure outside of the case body 41, i.e., greater than the atmospheric pressure.

At the lid 42, the exit 45 for discharging the blowby gas which has been separated the oil mist from the case body 41 id provided. Since the exit 45 is connected to the intake system of the gas engine 14, such as the intake manifold 14*i* via a pipe, it is formed in a negative pressure P2 where the pressure is lower than the atmospheric pressure.

In the blowby gas filter 40, as it passes through the filter 43, the oil which has been separated and removed from the blowby gas descends due to its own weight toward The bottom of the case body. Then, the oil passes through the outflow exit 46 and returns into the oil pan 14*a*. In the blowby gas filter 40, the case body 41 and the lid 42 do not come into contact with each other at the bottom of the case body 41, where the separated oil descends. Therefore, it is possible to solve the problem that the separated and removed oil leaks at the contact portion between the case body 41 and the lid 42.

In addition, in the oil separator 40, since the contact portion between the case body 41 and the lid 42 is formed in the negative pressure region P2 which is above the filter 43, the oil is less likely to leak from the oil separator.

(Second Embodiment)

Below, the second embodiment of the blowby gas filter according to the present invention will be explained referring to FIG. 4.

In addition to the members comprising the blowby gas filter 40 of the first embodiment, the blowby gas filter 40A of this embodiment further comprises a guide member for introducing the gaseous fluid, that is a guide member for introducing the blowby gas into the center of the filter 43. In this embodiment, as the guide member, the plate ring member 50 is provided so as to be integrated with the inside wall of the case body 41. The plate ring member 50 has a doughnut shape, and comprises a passage for the blowby gas at the center thereof. The plate ring member 50 is provided slightly above the entrance 44 for inward flow of the blowby gas. Moreover, the plate ring member 50 can be also used as a supporting member for the filter 43, as shown in FIG. 4.

In the blowby gas filter 40A, since the plate ring member 50 is provided, the blowby gas cannot flow along the inside wall of the case body 41. As a result, the blowby gas containing the oil mist, which is introduced into the blowby gas filter 40A from the entrance 44, rises as it is introduced into the center of the filter 43. Thereby, all or almost of the blowby gas can be made to pass through the filter 43, and flows out from the exit 45. Consequently, in the blowby gas filter 40A of this embodiment, it is possible to separate and remove the oil mist with certainty from the blowby gas.

In other words, if there is a gap S between the inside wall of the case body 41 and the filter 43, since the flow of the blowby gas containing the oil mist is introduced into the center of the filter 43 by the plate ring member 50, it is possible to prevent for the blowby gas from passing through the gap S. Thereby, the ratio of the blowby gas which contains the oil mist and flows out from the blowby gas filter 40A with respect to the blowby gas which flows into the blowby gas filter 40A can be significantly decreased. Therefore, it is possible to significantly improve the oil separation efficiency of the blowby gas filter 40A.

In addition, if the size of the hole which is formed at the center of the plate ring member 50 is too large, a large amount of the blowby gas passes through the gap S. In contrast, if it is too small, the separation efficiency can be improved, but the pressure loss increases. Therefore, it is preferable for the size of the hole which is formed at the center of the plate ring member 50 to be adjusted in accordance with the conditions.

(Third Embodiment)

Figure 5:
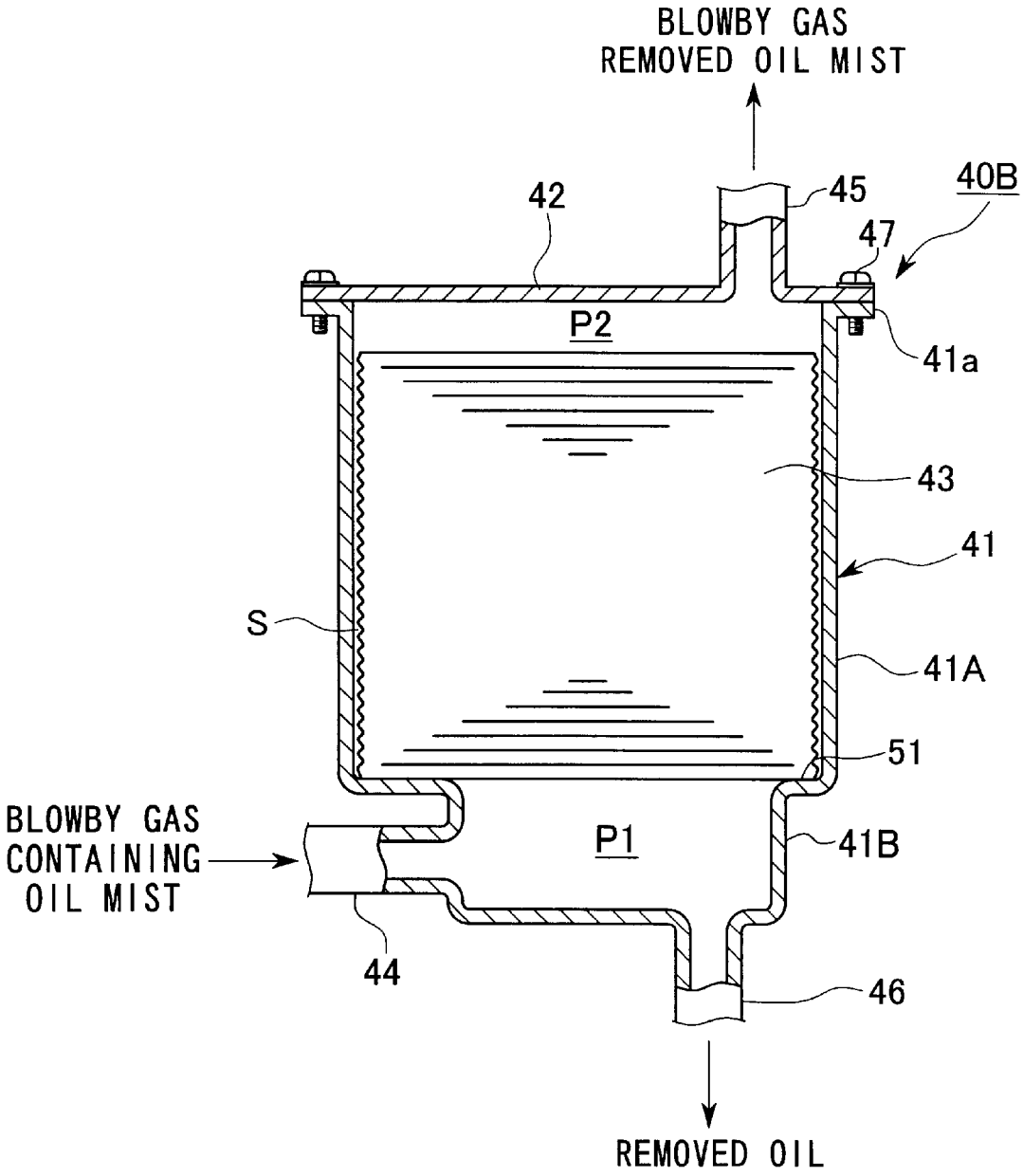
FIG. 5 is a cross-sectional view showing the third embodiment of the oil separator according to the present invention.

Below, the third embodiment of the blowby gas filter according to the present invention will be explained referring to FIG. 5.

The blowby gas filter 40B of this embodiment is a modified embodiment of the blowby gas filter 40A in the second embodiment shown in FIG. 4. Specifically, as the guide member for introducing the blowby gas into the center of the filter 43, a connection portion 51 is used in this embodiment, which connects a large upper portion 41A and a small lower portion 41B. In other words, in this embodiment, the case body 41 comprises the large upper portion 41A and the small lower portion 41B. They are connected by the connection portion 51. That is, the connection portion 51 is a plate member which protrudes approximately horizontally toward the inside of the case body 41 between the large upper portion 41A and the small lower portion 41B. The plate member acts as the plate ring member 50 in the second embodiment. In addition, the connection portion 51 is also used as a support member for supporting the filter 43, similar to the plate ring member 50 in the second embodiment.

In the blowby gas filter 40B, since the case body 41 comprises the connection portion 51, the blowby gas containing the oil mist which flows in through the entrance 44 is introduced into the center of the filter 43 as it rises. That is, since the gap S between the inside wall of the case body 41 the filter 43 is closed with the connection portion 51, all or almost of the blowby gas can be made to pass through the filter 43 and flows out from the exit 45. Consequently, in the blowby gas filter 40B of this embodiment, it is possible to separate and remove the oil mist with certainty from the blowby gas.

In other words, if there is a gap S between the inside wall of the case body 41 and the filter 43, since the flow of the blowby gas containing the oil mist gas is introduced into the center of the filter 43 by the connection portion 51, it is possible to prevent for the blowby gas from passing through the gap S. Thereby, the ratio of the blowby gas which contains the oil mist and flows out the blowby gas filter 40B with respect to the blowby gas which flows into the blowby gas filter 40B can be significantly decreased. As a result, it is possible to significantly improve the oil separation efficiency of the blowby gas filter 40B.

In addition, if the size of the hole which is formed at the center of the connection portion 51, i.e., the size of the small lower portion 41B, is too large, a large amount of the blowby gas passes through the gap S. In contrast, if it is too small, the separation efficiency can be improved, but the pressure loss increases. Therefore, it is preferable for the size of the hole which is formed at the center of the connection portion 51 to be adjusted in accordance with the conditions.

(Fourth Embodiment)

Figure 6:
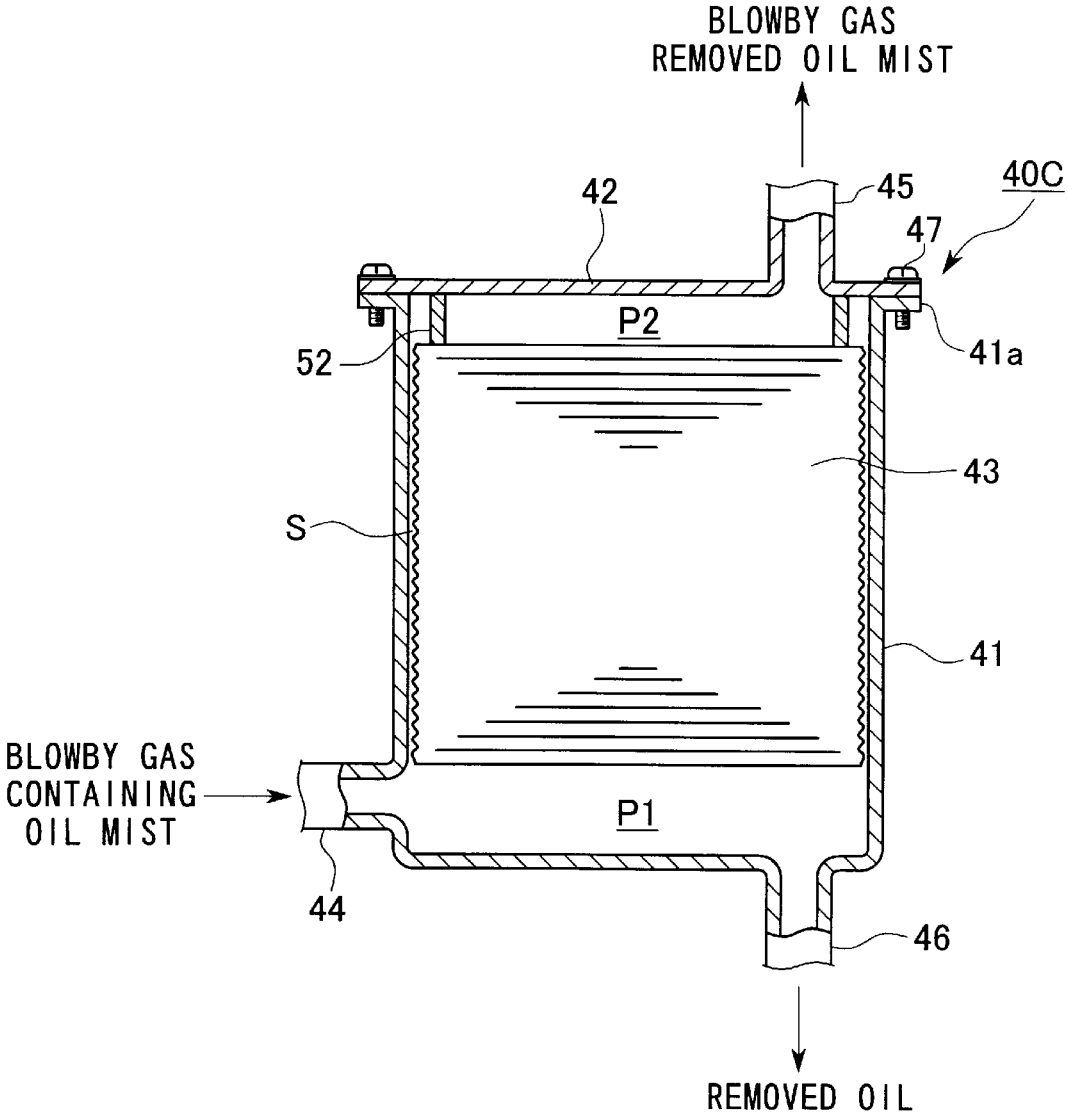
FIG. 6 is a cross-sectional view showing the fourth embodiment of the oil separator according to the present invention.

Below, the fourth embodiment of the blowby gas filter according to the present invention will be explained referring to FIG. 6.

The blowby gas filter 40C of this embodiment is a modified embodiment of the blowby gas filter 40A in the second embodiment shown in FIG. 4. Specifically, as the guide member for introducing the blowby gas into the center of the filter 43, a cylindrical member 52 is used, which is provided at the bottom surface of the lid 42 so as to protrude toward the inside of the case body 41. The cylindrical member 52 has a sectional shape which is similar to and smaller than that of the case body 41, and it contacts the filter 43. It is preferable for the cylindrical member 52 to be provided so that the bottom surface of the cylindrical member 52 contacts closely the top surface of the filter 43, as shown in FIG. 6.

In the blowby gas filter 40C, since the cylindrical member 52 is provided, the blowby gas containing the oil mist which passes through the gap S between the inside wall of the case body 41 the filter 43 cannot reach the negative pressure region P2 which is connected to the exit 45. Therefore, the blowby gas containing the oil mist which flows through the entrance 44 is introduced into the center of the filter 43 which contacts the negative pressure region P2 as it rises. Therefore, all or almost of the blowby gas can be made to pass through the filter 43 and flows out from the exit 45. Consequently, in the blowby gas filter 40C of this embodiment, it is possible to separate and remove the oil mist with certainty from the blowby gas.

In other words, if there is a gap S between the inside wall of the case body 41 and the filter 43, since the flow of the blowby gas containing the oil mist is introduced into the center of the filter 43 by the cylindrical member 52, it is possible to prevent the blowby gas from passing through the gap S. Thereby, the ratio of the blowby gas which contains the oil mist and outward flows from the blowby gas filter 40C with respect to the blowby gas which flows into the blowby gas filter 40C can be significantly decreased. As a result, it is possible to improve the separation efficiency of the blowby gas filter 40C.

As explained above, in the blowby gas filter, that is, the oil separator of the present invention, since the lid 42 which is used to change the filter 43 is provided above the case body 41, it is possible to prevent the oil which has been separated and removed from the blowby gas by the filter 43 from leaking at the contact portion between the case body 41 and the lid 42. In addition, since the structure of the seal for the contact portion between the case body 41 and the lid 42 is simple, they can be easily formed at a low cost.

In particular, if the oil separator of the present invention is used for the gaseous fluid, such as the blowby gas, since the entrance 44 is provided in a positive pressure region P1 and the exit 45 is formed in a negative pressure region P2, the contact portion between the case body 41 and the lid 42 is provided in the negative pressure region P2. As a result, it is possible to prevent the oil from leaking with more certainty.

In addition, if the guide member, such as the plate ring member 50, connection portion 51, or the Cylindrical member 52 is provided, it is possible to solve the problem that the blowby gas containing the oil mist passes through the gap S between the inside wall of the case body 41 and the filter 43, without passing through the filter 43 and flows out from the exit 45. That is, all or almost of the blowby gas can be made to pass through the filter 43 and flows out from the exit 45. Consequently, in the blowby gas filter of the present invention, it is possible to separate and remove the oil mist with certainty from the blowby gas. Thereby, the oil separation efficiency of the oil separator can be improved. In other words, if there is a gap S between the inside wall of the case body 41 and the filter 43, the amount of the blowby gas passing through the gap S is significantly decreased. Therefore, deterioration of oil separation efficiency decrease due to this can be prevented.

In the above, the oil separators of the present invention are used for the blowby gas of the gas engine 14 comprising the GHP. That is, the oil separator of the present invention is explained as a blowby gas filter. However, the oil separators of the present invention are not specifically limited to the above embodiments. The blowby gas exit of the oil separators of the present invention can be provided the place of which the pressure is not smaller than the atmospheric pressure. In addition, the present invention is not limited to the above embodiments, and the constitution of the oil separator according to the present invention can be changed as far as the change of the constitution is within the scope of the present invention.

In addition, the structure for preventing oil leaks in the first embodiment and the structure for improving the oil separation efficiency in the second, third, and fourth embodiments can be adopted individually. However, if these structures are used together, it is possible to further improve the performance of the oil separator.

(Fifth Embodiment)

Figure 7A:
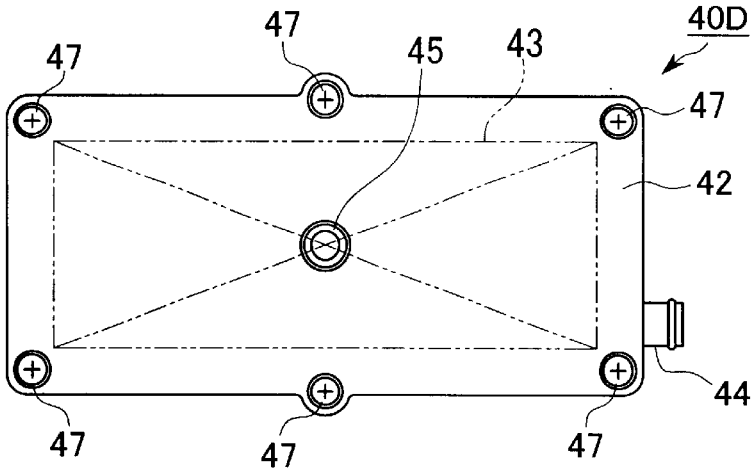
FIG. 7A is a planar view showing the fifth embodiment of the oil separator according to the present invention viewed from the top side.

Below, the fifth embodiment of the blowby gas filter according to the present invention will be explained referring to FIGS. 7A and 7B.

Figure 7B:
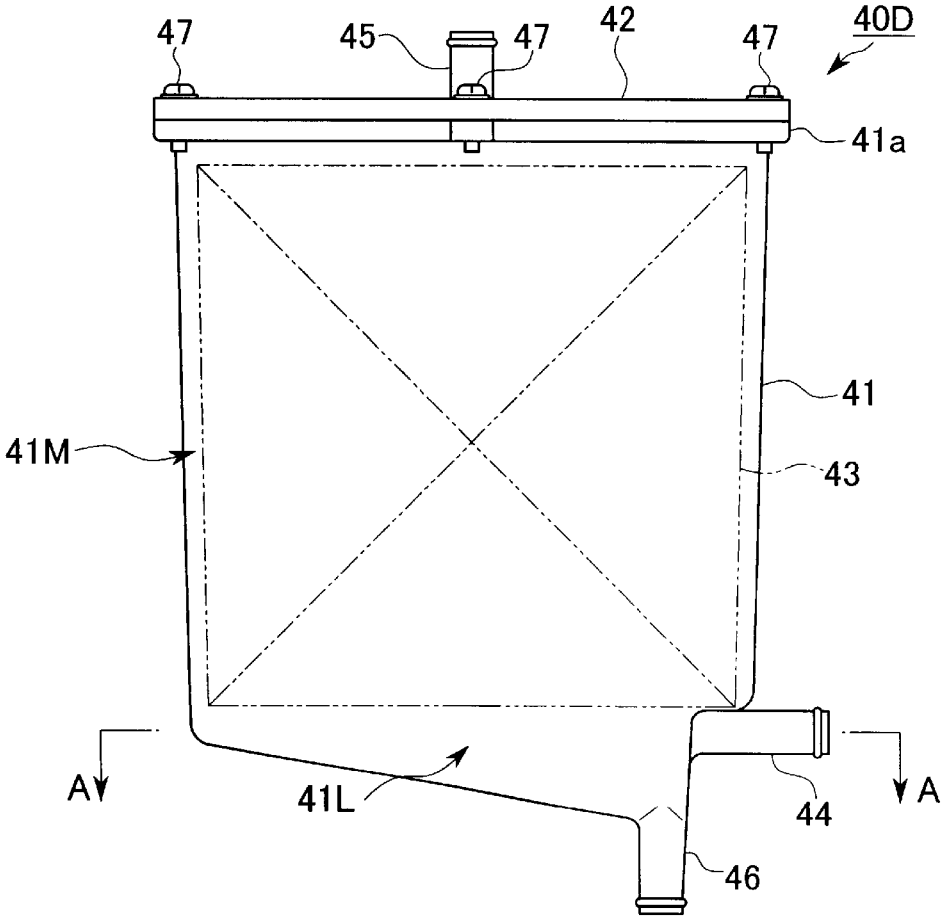
FIG. 7B is a planar view showing a fifth embodiment of the oil separator according to the present invention viewed from the front side.

As shown in FIG. 7B, the blowby gas filter 40D comprises the hollow case body 41 comprising the opening at the top thereof, the lid 42 for covering the opening formed in the case body 41, and the filter 43 which is made of nonwoven fabrics and is put into the case body 41. Moreover, the casing of the blowby gas filter 40 comprises the case body 41 and the lid 42. In addition, in FIGS. 7A and 7B, reference numeral 44 denotes the entrance for inward flow of the blowby gas containing the oil mist, 45 denotes the exit for outward flow of the blowby gas in which the oil mist has been separated, and 46 denotes the outflow exit for outward flow of the separated oil.

The case body 41 has a hollow rectangular shape, and is made of synthetic resins. At the top of the case body 41, an opening is provided. Around the opening, the flange 41*a* is provided. In addition, as shown in FIGS. 7A and 7B, the lid 42 is a plate member made of synthetic resins having a size approximately equals to the flange 41*a*. The case body 41 and the lid 42 are fixed by covering the opening with the lid 42 and bolting them together using the fixing members 47. As the fixing member 47, members, which can removably attach the lid 42, such as a bolt and a nut, can be used. In addition, as shown in FIG. 3, the O-ring 48 which is a seal member is provided in the flange 41*a*.

The case body 41 comprises the entrance 44 for flowing of the blowby gas containing the oil mist into the casing and the outflow exit 46 for outward flow of the oil which has been separated and removed from the blowby gas, which are provided at the circular flow formation portion 41L below the filter 43. In addition, in the case body 41, the filter portion 41M for positioning the filter 43 is provided above the circular flow formation portion 41L.

The blowby gas entrance 44 is provided at the lower side of the case body 41, and connected to the crank case 14*f* of the gas engine 14 via a pipe. Specifically, as shown in FIG. 7A, the entrance 44 is provided at short side of the case body 41 so that it contacts to the long side of the circular flow formation portion 41L and the center thereof does not meet to the center of the short side of the circular flow formation portion 41L. Due to this position, the blowby gas flowing through the entrance 44 flows into the casing along the long side of the circular flow formation portion 41L. In addition, the outflow exit 46 is provided at the bottom of the case body 41 so as to accumulate the oil which descends its own weight and discharge, and it is connected to the oil pan 14*a* via a pipe.

Since the circular flow formation portion 41L in which the blowby gas entrance 44 and the outflow exit 46 are provided is connected to the crank case 14*f*, the pressure of the circular flow formation portion 41L is greater than the pressure outside of the casing, i.e., greater than the atmospheric pressure. That is, the circular flow formation portion 41L is provided in a positive pressure region.

At the lid 42, the blowby gas exit 45 for discharging the blowby gas from which the oil has been separated and removed from the casing is provided. Since the blowby gas exit 45 is connected to the intake system of the gas engine 14, such as the intake manifold 14*i* via a pipe, it is formed in a negative pressure region P2 of which the pressure is lower than the atmospheric pressure.

In the blowby gas filter 40D, since the circular flow formation portion 41L make the flow of the blowby gas circulate, it can separate the oil mist from the blowby gas by the centrifugal force. As a result, the oil mist, which has a weight greater than that of the gas contained in the blowby gas, moves outwardly and adheres to the inside wall of the case body 41. Then, the oil mist descends to the bottom of the casing due to its own weight. In contrast, the gas contained in the blowby gas, which has a weight smaller than that of the oil mist, is separated from the oil mist, circulates near the center of the filter 43 as it rises. As a result, the gas passes through the filter 43, flows out through the blowby gas exit 45 which is provided in a negative pressure region, and flows into the intake manifold 14*i*. The oil mist which has not been separated by the circular flow formation portion 41L is absorbed in the filter 43, and thereby it is separated and removed.

As explained above, in the blowby gas filter 40D in this embodiment, the circular flow formation portion 41L and the filter portion 41M are provided together. Therefore, the oil mist is separated from the blowby gas due to the effects provided by the circular flow formation portion 41L and the filter 43. In addition, the pressure loss of the blowby gas filter 40D of this embodiment is significantly smaller than that of the conventional blowby gas filter in which the thickness of the filter increases in order to obtain the oil mist separation efficiency which substantially equals to that of the blowby gas filter 40D.

Figure 8:
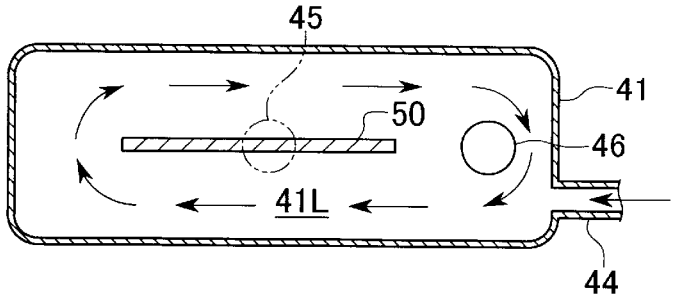
FIG. 8 is a cross-sectional view along line A—A of FIG. 7B.

In addition, in this embodiment, the flow of the blowby gas is made circulate only by providing the entrance 44 so that the center of the entrance 44 does not meet to the center of the short side of the circular flow formation portion 41L. However, as shown in FIG. 8, it is preferable to provide the separation member 50 having a long cross-section at the vicinity of the circular flow formation portion 41L, in order to assist the formation of the circular flow of the blowby gas. If such separation member 50 is provided, the blowby gas which flows in through the entrance 44 easily circulates along the separation member 50. Beside the separation member 50 shown in FIG. 8, a plane guide or a curved guide may be provided at the suitable position, such as a corner of the circular flow formation portion 41L. In addition, it is preferable for the circular flow formation portion 41L to curve the corners thereof. Thereby, it is possible to make the flow of the blowby gas more smoothly. In particular, in order to make the flow of the blowby gas circulate, it is preferable for the cross section of the circular flow formation portion 41L to be an oval, and more preferable is a circle. However, when the space required for placing the blowby gas filter 40D is considered, the cross section of the circular flow formation portion 41L may be preferably a rectangular shape or a rectangular shape of which the corners are curved.

It is preferable for the blowby gas exit 45 to be provided at the center of lid 42 as shown by an imaginary line in FIG. 8. Due to this, it is also possible to form the smooth flow of the blowby gas. Since the flow of the blowby gas passes through the center of filter 43 and flows out through the blowby gas exit 44, the oil mist can be separated and removed by the filter 43 with certainty.

As explained above, the blowby gas filter 4D is used for separating blowby gas of the gas engine 14 comprising the GHP. However, the present invention is not limited to the oil separator for the gas engine comprising the GHP. For example, the present invention can include the oil separator in which the exit is not provided in a negative pressure region.

Figure 11:
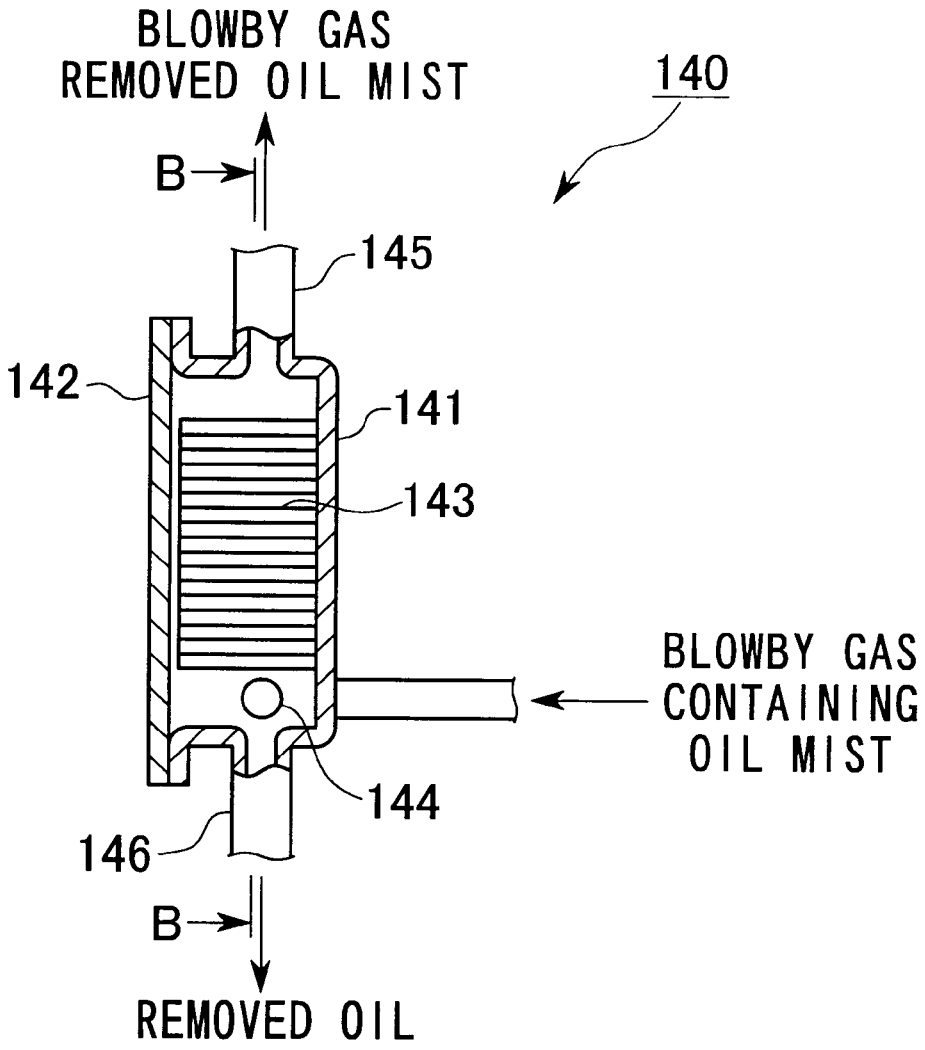
FIG. 11 is a cross-sectional view showing a conventional oil separator.
Figure 12A:
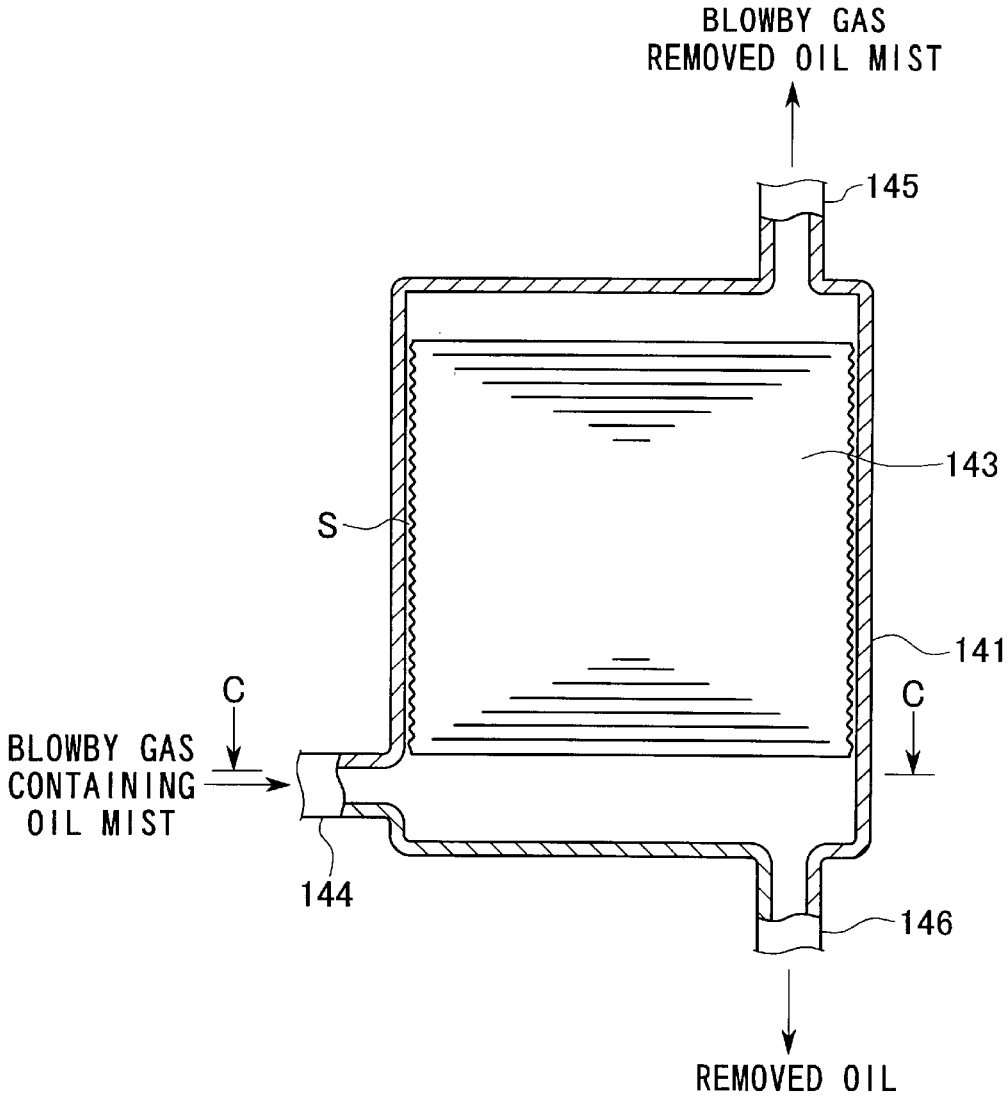
FIG. 12A is a cross-sectional view along line B—B of FIG. 11.
Figure 12B:
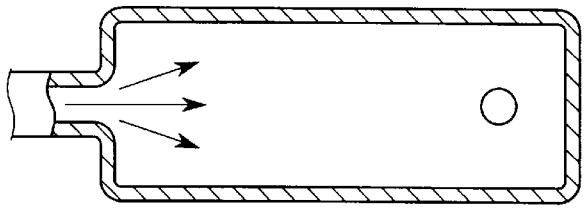
FIG. 12B is a cross-sectional view along line C—C of FIG. 12A.

In addition, the present invention is not limited to the above embodiment, and the constructions of the oil separator according to the present invention can be changed as far as the change of the constructions is within the scope of the present invention. For example, the lid 42 may be provided at the side surface of the casing as shown in FIG. 11.

What is claimed is:

1. An oil separator for separating oil from a gaseous fluid containing oil in the state of a mist, comprising:

a hollow case body comprising an opening at a top thereof;

a lid for covering said opening formed at said case body; and a filter in said case body, wherein:

an entrance for inward flow of said gaseous fluid into said case body is formed at a lower side of said case body, an exit for outward flow of said gaseous fluid is formed at said lid, and an outflow exit for outward flow of oil which has been separated is formed at a bottom of said case body;

said oil separator further comprises a guide for introducing said gaseous fluid flowing from said entrance to said exit into a center of said filter; and said guide is a cylindrical member provided at a bottom surface of said lid so as to protrude toward an inside of said case body.

2. An oil separator for separating oil from a gaseous fluid containing oil in the state of a mist, comprising:

a circular flow formation portion for generating a circular flow of said gaseous fluid introduced in a casing; and a filter portion in which said circular flow of said gaseous fluid passes, wherein:

an entrance for inward flow of said gaseous fluid is provided at a lower side of said casing, an exit for outward flow of said gaseous fluid is provided at a top surface of said casing, an outflow exit for outward flow of said oil which has been separated is formed at a bottom of said casing, and said circular flow formation portion is provided at a lower portion of said casing; and said gaseous fluid is a blowby gas of an internal combustion engine, said entrance is connected to a crank case of said internal combustion engine, and said exit is connected to an intake system of said internal combustion engine.

* * * * *